US008870145B1

(12) United States Patent
Carlson et al.

(10) Patent No.: US 8,870,145 B1
(45) Date of Patent: Oct. 28, 2014

(54) CLOTHES HANGING ASSEMBLY

(71) Applicants: Gordon G. Carlson, Irvine, CA (US); Lois Carlson, Irvine, CA (US)

(72) Inventors: Gordon G. Carlson, Irvine, CA (US); Lois Carlson, Irvine, CA (US)

( * ) Notice: Subject to any disclaimer, the term of this patent is extended or adjusted under 35 U.S.C. 154(b) by 0 days.

(21) Appl. No.: 13/750,364

(22) Filed: Jan. 25, 2013

(51) Int. Cl.
*A47F 5/00* (2006.01)
*E04G 25/00* (2006.01)
*F16M 13/00* (2006.01)

(52) U.S. Cl.
USPC ..... 248/352; 248/317; 248/328; 248/329; 248/330.1

(58) Field of Classification Search
USPC ..... 254/390, 394; 248/330.1, 352, 329, 328
See application file for complete search history.

(56) References Cited

U.S. PATENT DOCUMENTS 1,663,297 A 3/1928 Fruehauf
3,176,851 A 4/1965 Mueller
3,467,460 A 9/1969 Acker
3,872,972 A * 3/1975 Cummins et al. ..... 211/17
5,226,569 A 7/1993 Watjer et al.
5,263,687 A * 11/1993 Garbiso ..... 254/334
5,890,452 A 4/1999 Lundeen et al.
5,897,104 A * 4/1999 Garbiso ..... 254/334
6,149,020 A 11/2000 Gumpel et al.
6,634,610 B1 * 10/2003 Ricci et al. ..... 248/330.1
7,165,688 B2 1/2007 Cameron
7,201,685 B2 * 4/2007 Terada et al. ..... 474/70
7,527,242 B2 * 5/2009 Shaha ..... 254/286
7,631,854 B1 * 12/2009 Mountain ..... 254/390
8,033,529 B2 * 10/2011 Boda et al. ..... 254/372
8,056,883 B1 * 11/2011 Brockie ..... 254/278
2012/0180267 A1 * 7/2012 LeBeau ..... 24/134 R

* cited by examiner

*Primary Examiner* — Amy J Sterling
(74) *Attorney, Agent, or Firm* — Robert C. Montgomery; Montgomery Patent and Design

(57) ABSTRACT

The invention is a clothes hanging assembly comprising a ceiling-mounted support structure and a height adjustable clothes hanging rod. The support structure includes a plurality of cords and pulleys which enable the rod to be raised or lowered. The rod and hanging clothes items may be hoisted to an elevated position adjacent to the ceiling for drying of clothes or storage of the assembly in a space-saving manner.

5 Claims, 2 Drawing Sheets

CLOTHES HANGING ASSEMBLY

RELATED APPLICATIONS

Not applicable.

FIELD OF THE INVENTION

The presently disclosed subject matter is directed toward devices for hanging clothes. More particularly, the present invention is directed to an adjustable height, ceiling-mounted clothes hanging assembly.

BACKGROUND OF THE INVENTION

Doing laundry is perhaps one of the most hated chores commonly performed in households. The gathering, sorting, washing, drying, folding, ironing, and returning of clothes to their storage location is a difficult, time consuming, seemingly never ending, and usually thankless task.

Compounding the foregoing problems is that many clothes, such as sweaters, fragile fabrics, and the like, are often dried on hangers to avoid the aggressive and damaging processes of automatic dryers. This is not only time consuming but it can take up valuable living space. Hanger-dried clothes may also get more wrinkled and perhaps get soiled while they hang. In any event, using a hanger can certainly make a laundry area look very cluttered and unorganized.

In view of the problems with automatic dryers and hangers there exists a need for a means by which laundry on hangers can be temporarily hung in an easily accessible location, without the disadvantages as described above. In particular, a clothes hanging system that is easily used, keeps clothes out of the way while drying, reduces the chances of hanging clothes getting soiled, but does not take up valuable floor space would be highly beneficial.

SUMMARY OF THE INVENTION

The principles of the present invention provide for a clothes hanging system that is easily used, keeps clothes out of the way while drying, reduces the chances of hanging clothes getting soiled, and does not take up valuable floor space.

The invention utilizes a wood mounting bracket that is approximately five feet (5 in.) long, and a few inches wide. It is mounted directly to a ceiling near a laundry area. The wood mounting bracket is provided with two (2) pulleys at its outer ends. Next, two (2) runs of cable are routed through the pulleys, and then terminated on an aluminum rod that is also about five feet (5 ft.) long. Finally, a set of mechanical stops on the cables determines the upper and lower limit of travel. In the lowered state, the rod is about four to five feet (4-5 ft.) off of the floor, and can be loaded with wet clothes that are on hangers. The clothes are then raised to the ceiling where they are out of the way, and can dry. When dry, the clothes rod can be lowered, and the clothes removed. The process is then repeated as needed. Such features, allow the clothes to dry out of the way where they will not get dirty or damaged.

A clothes hanging assembly in accord with the present invention includes an elongated mounting frame having a top that is configured to attach to a flat surface. The mounting frame includes a cord stop mechanism, a first pulley, and a second pulley. The clothes hanging assembly further includes a rod having a first end and a second end and which is configured to receive a plurality of hangers. A first cord passes through the cord stop mechanism, over the first pulley and down to the first end. A second cord passes through the cord stop mechanism, over the second pulley and down to the second end. The rod can be raised by pulling down on the first cord and the second cord. The rod also can be lowered by allowing the first cord and the second cord to rise and locked in position by the cord stop mechanism.

The top may include apertures for receiving fasteners to attach the clothes hanging assembly to a flat surface. In addition, a pulley bracket may hold the first pulley in position while the first pulley may include an internal bearing. The rod may include a first eyelet for receiving the first cord. Beneficially, the mounting frame is "L"-shaped and the first pulley and the second pulley attach to an "L" leg. The cord stop mechanism may include a housing that is affixed to the mounting frame using a plurality of fasteners. In practice the cord stop mechanism may include a spring-biased pinch cam that is adjacent a gripping surface. The first cord and the second cord may pass between the pinch cam and the gripping surface. The cord stop mechanism may include a third pulley having two (2) grooves.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
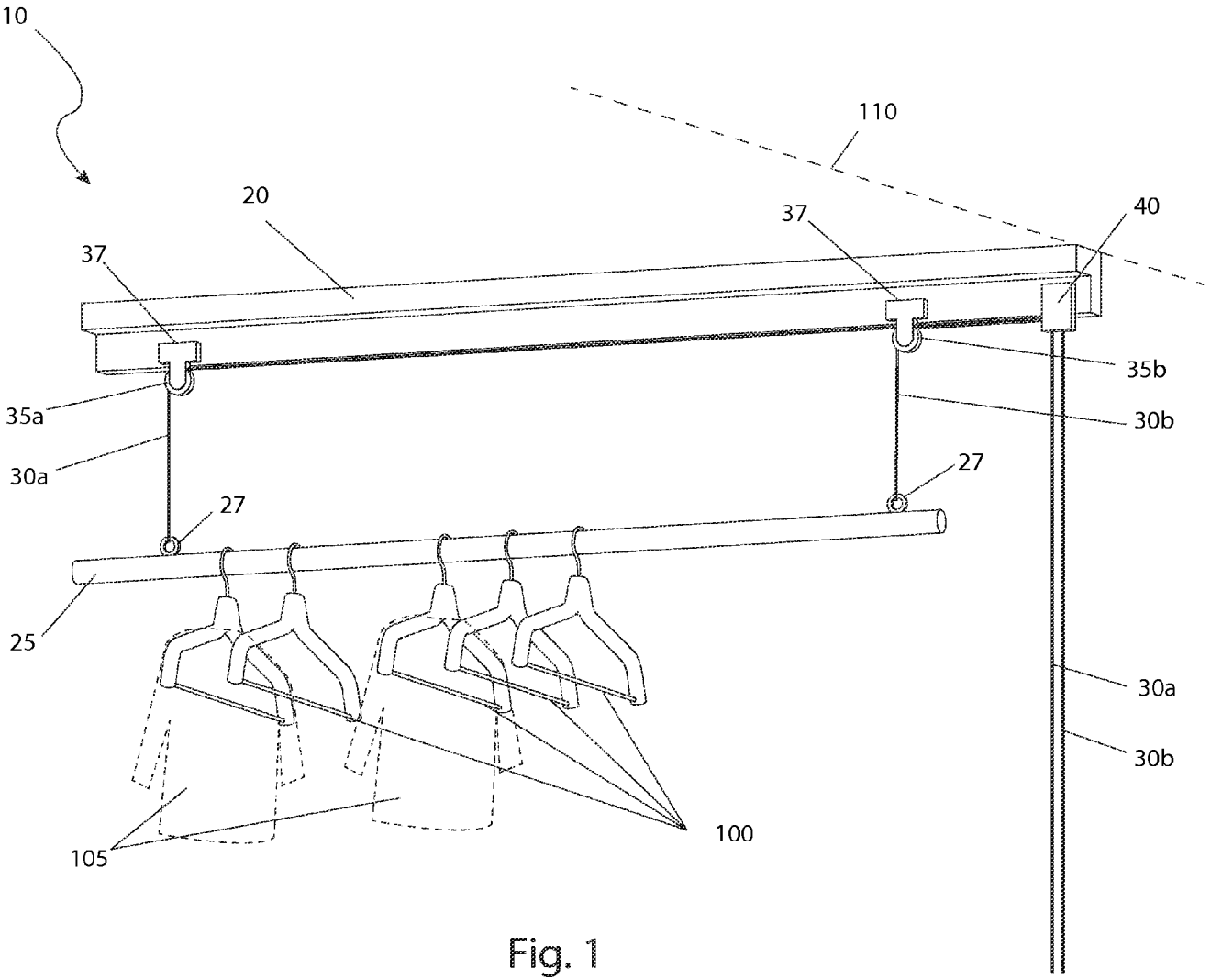
FIG. 1 is a perspective view of a clothes hanging assembly 10 that is in accord with a preferred embodiment of the present invention and depicted in an in-use state; and, FIG. 2 is a close-up view of a cord stop mechanism 40 used in the clothes hanging assembly 10 shown in FIG. 1.

10 clothes hanging assembly
20 mounting frame
25 rod
27 eyelet
30*a* first cord
30*b* second cord
35*a* first pulley
35*b* second pulley
37 pulley bracket
40 cord stop mechanism
42 housing
44*a* pinch cam
44*b* gripping surface
46 spring
48 third pulley
80 anchoring fastener
82 threaded fastener
100 hanger
105 clothes
110 ceiling

DETAILED DESCRIPTION OF THE PREFERRED EMBODIMENT

Figure 2:
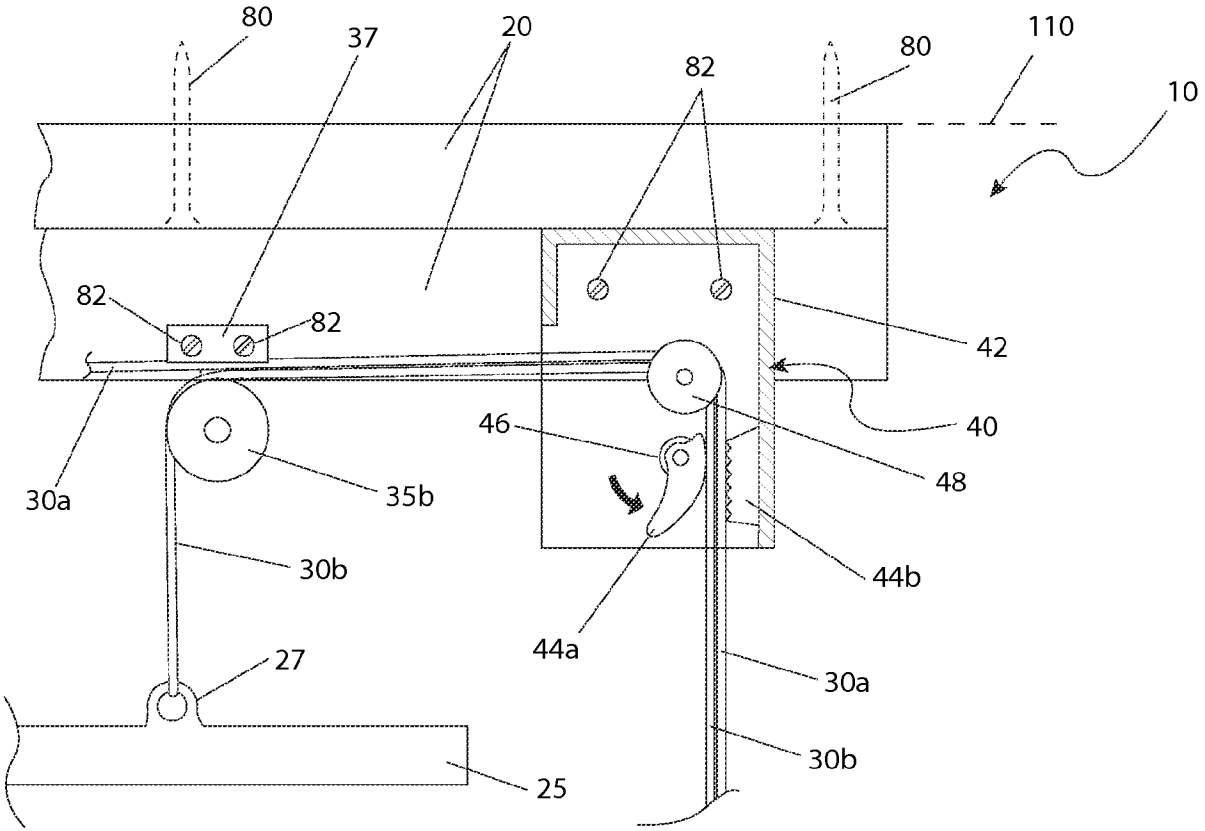

The best mode for carrying out the invention is presented in terms of its preferred embodiment, herein depicted within FIGS. 1 and 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Refer now to FIG. 1 for a perspective view of a preferred embodiment clothes hanging assembly 10. The clothes hanging assembly 10 is a ceiling-mounted system for hanging clothes 105. The clothes hanging assembly 10 includes a clothes hanger rod 25 for hanging clothes 105 indoors, preferably near a laundry area. The clothes hanger rod 25 can be raised or lowered by a user such that clothes 105 on common hangers 100 may be raised near the ceiling 110 where they are out of the way and can dry. Once dry, the clothes rod 25 can be lowered and the clothes 105 removed. The process can then be repeated as needed. Such features allow the drying of clothes 105 while conserving space and avoiding the risk of soiling or damaging the clothes 105.

The clothes hanging assembly 10 has a mounting frame 20, a first cord 30*a*, a second cord 30*b*, a first pulley 35*a*, a second pulley 35*b*, and a cord stop mechanism 40. The mounting frame 20 is an elongated linear member that is approximately five (5) feet in length and has an "L"-shaped cross-section. The mounting frame 20 has a flat top surface that facilitates mounting the clothes hanging assembly 10 near the ceiling 110 or another flat surface by using a plurality of anchoring fasteners 80 (see FIG. 2) such as screws, wall anchors, and the like.

The mounting frame 20 provides a vertical surface onto which pulley brackets 37 for the first 35*a* and second 35*b* pulleys are affixed. The pulleys are attached at outer ends thereof using threaded fasteners 82 such as screws, bolts, or the like. The first 35*a* and second 35*b* pulleys are envisioned as being plastic single-groove axial units having internal bushings or ball bearings for smooth operation.

The rod 25 is also approximately five feet (5 ft.) in length and preferably made using a round bar shape and is preferably made of aluminum or other light-weight material. The rod 25 is supported by the cords 30*a*, 30*b* and is maintained in a parallel relationship with the ceiling 110. The rod 25 is raised and lowered synchronously via the cords 30*a*, 30*b*. The rod 25 provides an attachment to the proximal ends of the cords 30*a*, 30*b* via tying or other attachment mechanisms to respective integral eyelets 27 of the rod 25. The eyelets 27 are beneficially located directly below the pulleys 35*a*, 35*b*. The cords 30*a*, 30*b* extend up from the eyelets 27 and are subsequently routed through the respective pulleys 35*a*, 35*b*. The cords 30*a*, 30*b* in turn extend horizontally through the cord stop mechanism 40 (see FIG. 2). The distal ends of the cords 30*a*, 30*b* hang down, thereby providing access to a user for grasping, pulling, and releasing to raise and lower the rod 25 and hanging clothing 105.

When lowered the rod 25 is envisioned as being four to five feet (4-5 ft.) off of a floor. This provides convenient loading and unloading of clothes 105 positioned on the common hangers 100. It should be understood that in addition to the preferred embodiment the clothes hanging assembly 10 may be introduced in various dimensions based upon a user's preference and space limitations.

Refer now to FIG. 2, a close-up view of the cord stop mechanism 40 of the clothes hanging assembly 10. The clothes hanging assembly 10 with its cord stop mechanism 40 provides a mechanism to selectively position and retain the rod 25 at a desired height. The cord stop mechanism 40 includes a rectangular metal or plastic housing 42 that is affixed to a vertical surface of the mounting frame 20 using a plurality of threaded fasteners 82 such as screws.

The housing 42 discreetly houses a pinch cam 44*a*, a gripping surface 44*b*, and a third pulley 48. The pinch cam 44*a* comprises a rotating and spring-loaded device being acted upon by a torsion spring 46. The pinch cam 44*a* is in mechanical communication with the stationary knurled or grooved gripping surface 44*b* to pinch and arrest the motion of the cords 30*a*, 30*b* within the cord stop mechanism 40. The cords 30*a*, 30*b* extend horizontally from the aforementioned pulleys 35*a*, 35*b*; are routed around the third pulley 48, envisioned to be a two-groove unit, within the cord stop mechanism 40, and are finally routed downwardly between the pinch cam 44*a* and gripping surface 44*b*. The pinch cam 44*a* and gripping surface 44*b* are envisioned as operating in a similar manner as conventional window blinds by providing a pinching and locking effect when the hanging cords 30*a*, 30*b* occupy a side-ways angle.

It is envisioned that other styles and configurations of the present invention can be easily incorporated into the teachings of the present invention, and while only one particular configuration was shown and described that was for purposes of clarity and disclosure and not by way of limitation of scope.

The preferred embodiment of the present invention can be used by the common user in a simple and effortless manner with little or no training. After initial purchase or acquisition of the clothes hanging assembly 10, it would be installed as indicated in FIG. 1.

The method of installing the clothes hanging assembly 10 may be achieved by performing the following steps: procuring a model of the clothes hanging assembly 10 having a desired overall length; fastening the mounting frame 20 of the clothes hanging assembly 10 to an existing ceiling 110 using anchoring fasteners 80, preferably fastening to ceiling joists; tying or otherwise attaching the cords 30*a*, 30*b* to the eyelets 27 of the rod 25, if not previously affixed; routing the cords 30*a*, 30*b* through the first 35*a* and second 35*b* pulleys; routing the cords 30*a*, 30*b* horizontally into the cord stop mechanism 40; routing the cords 30*a*, 30*b* around the third pulley 48 and downwardly between the pinch cam 44*a* and gripping surface 44*b* of the cord stop mechanism 40; and, adjusting the relative length of the cords 30*a*, 30*b* until the rod 25 is parallel to the ceiling 110.

The method of using the clothes hanging assembly 10 may be achieved by performing the following steps: grasping and motioning the cords 30*a*, 30 until the rod 25 is positioned at a desired distance above the floor; applying a side-ways angle to the cords 30*a*, 30*b* to lock the cords 30*a*, 30*b* in position; loading a desired number of clothing items 105 on hangers 100 upon the rod 25; raising the rod 25 by pulling downwardly upon the hanging portions of the cords 30*a*, 30*b* until obtaining another desired height of the rod 25; retaining the rod 25 and clothes 105 at an elevated position by applying a side-ways angle to the cords 30*a*, 30*b* and releasing; lowering the rod 25 and clothes 105 by tugging downwardly upon the cords 30*a*, 30*b* and allowing the cords 30*a*, 30*b* to pass upwardly through the cord stop mechanism 40 until the rod 25 and clothes 105 are lowered to a height being convenient for unloading; unloading the clothes 105 from the rod 25; repeating the above process as needed; positioning the clothes hanging assembly 10 for storage by raising the rod portion 25 of the clothes hanging assembly 10 upwardly, as described above, to a position adjacent to the ceiling 110 until needed again; and, benefiting from a compact and space-saving clothes hanging means afforded a user of the clothes hanging assembly 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A clothes hanging assembly, comprising:

an elongated mounting frame having an L shaped cross-section with a top configured to attach to a flat surface;

a first pulley on a first bracket affixed to said mounting frame;

a second pulley on a second bracket affixed to said mounting frame;

a stop mechanism attached to said mounting frame, said stop mechanism including a pinch cam, a gripping surface, and a third pulley;

a rod having a first end with an adjacent integral first eyelet and a second end configured with an adjacent integral second eyelet;

a first cord passing over said third pulley, over said first pulley and down to said first eyelet; and, a second cord passing over said third pulley, over said second pulley and down to said second eyelet;

wherein said rod can be locked in position by said pinch cam.

2. The clothes hanging assembly according to claim 1, wherein said top includes apertures for receiving fasteners to attach to a flat surface.

3. The clothes hanging assembly according to claim 1, wherein said stop mechanism includes a housing affixed to said mounting frame using a plurality of fasteners.

4. The clothes hanging assembly according to claim 1, wherein said pinch cam is adjacent said gripping surface, and wherein said first cord and said second cord pass between said pinch cam and said gripping surface.

5. The clothes hanging assembly according to claim 4, wherein said pinch cam is biased toward said gripping surface.

* * * * *